US011033063B2

(12) United States Patent
Warsaw et al.

(10) Patent No.: US 11,033,063 B2
(45) Date of Patent: Jun. 15, 2021

(54) REVERSIBLE BEANIE WITH A POM-POM

(71) Applicant: Shanghai Pacific Hat Manufacturing Co., LTD, Shanghai (CN)

(72) Inventors: Joshua Warsaw, Ventura, CA (US); Yan Sun, Shanghai (CN); Chia-Ching Tsai, Shanghai (CN)

(73) Assignee: Shanghai Pacific Hat Manufacturing Co., LTD, Shanghai (CN)

( * ) Notice: Subject to any disclaimer, the term of this patent is extended or adjusted under 35 U.S.C. 154(b) by 109 days.

(21) Appl. No.: 16/491,329

(22) PCT Filed: Mar. 7, 2017

(86) PCT No.: PCT/CN2017/075897
§ 371 (c)(1),
(2) Date: Sep. 5, 2019

(87) PCT Pub. No.: WO2018/161258
PCT Pub. Date: Sep. 13, 2018

(65) Prior Publication Data

US 2020/0015534 A1 Jan. 16, 2020

(51) Int. Cl.
*A42B 1/206* (2021.01)
*A42B 1/24* (2021.01)
*A42B 1/041* (2021.01)

(52) U.S. Cl.
CPC ..... *A42B 1/206* (2013.01); *A42B 1/24* (2013.01); *A42B 1/041* (2013.01)

(58) Field of Classification Search
CPC ..... A42B 1/004; A42B 1/04; A42B 1/041; A42B 1/206; A42B 1/248; A42B 1/24;
(Continued)

(56) References Cited

U.S. PATENT DOCUMENTS 968,922 A * 8/1910 Delzeit ..... A42B 1/02 2/209.7
1,111,659 A 9/1914 Le Pierre
(Continued)

FOREIGN PATENT DOCUMENTS

CN 104799471 A 7/2015
DE 202013002012 U1 5/2013
(Continued)

OTHER PUBLICATIONS

Extended European Search Report dated Oct. 9, 2020 for European Application No. EP17899772.2-1017 / 3592163, 6 pages.
(Continued)

*Primary Examiner* — Amy Vanatta
(74) *Attorney, Agent, or Firm* — Locke Lord LLP

(57) ABSTRACT

A reversible headwear (100), such as a beanie, includes a reversible headwear body (110) and a pom-pom (150) connected thereto. The reversible headwear body (110) is adjustable between a first configuration and a second configuration. The headwear body (110) has a first surface (112) and an opposite second surface (114). The first and second surfaces (112, 114) correspond to outer and inner surfaces respectively in the first configuration of the headwear body (110), and to the inner and outer surfaces respectively in the second configuration of the headwear body (110). The headwear body (110) has a through-hole (130) extending from the first surface (112) to the second surface (114). The pom-pom (150) is configured to be connected to the headwear body (110) to allow movement of the connected pom-pom (150) through the through-hole (130) for positioning the connected pom-pom (150) over the opening on or over the outer surface when the headwear body (110) is in the first configuration or the second configuration.

20 Claims, 8 Drawing Sheets

(58) Field of Classification Search
CPC ..... A42B 1/006; A42B 1/045; A42B 5/00; A42C 5/00; A42C 99/00; A41D 15/005; A41D 23/00; A41D 27/08; D04D 7/06; D04D 7/04
USPC ..... 2/DIG. 2; 223/44, 46
See application file for complete search history.

(56) References Cited

U.S. PATENT DOCUMENTS

| | | | | | |
|---|---|---|---|---|---|
| 1,503,537 | A * | 8/1924 | Knopfler | A42B 1/0186 | 2/202 |
| 2,038,398 | A | 4/1936 | Wengen | | |
| 2,069,020 | A * | 1/1937 | Schuessler | A42B 1/041 | 2/182.1 |
| 2,159,609 | A * | 5/1939 | Wengen | A42B 1/041 | 2/209 |
| 2,322,060 | A * | 6/1943 | Samuels | D04D 7/06 | 28/147 |
| 2,479,239 | A * | 8/1949 | Johnson | A42B 1/248 | 2/171.01 |
| 3,429,019 | A * | 2/1969 | Linstead | D04D 7/06 | 28/147 |
| 3,602,918 | A * | 9/1971 | Krystal | A42B 1/041 | 2/195.7 |
| 4,074,365 | A * | 2/1978 | Schuessler | A42B 1/041 | 2/195.8 |
| 4,716,599 | A | 1/1988 | Bell | | |
| 5,771,493 | A * | 6/1998 | Proctor | A42B 1/004 | 2/171.1 |
| 6,094,749 | A * | 8/2000 | Proctor | A42B 1/004 | 2/171.1 |
| 9,375,042 | B1 * | 6/2016 | Koziol | A42B 1/225 | |

FOREIGN PATENT DOCUMENTS

| | | | | |
|---|---|---|---|---|
| EP | 0815753 | A1 * | 1/1998 | A42B 1/0184 |
| EP | 1092357 | A2 | 4/2001 | |
| FR | 387004 | A * | 6/1908 | A42B 1/0189 |
| FR | 2297577 | A1 | 8/1976 | |
| FR | 3018828 | A1 * | 9/2015 | A42B 1/004 |
| JP | 3052144 | U | 9/1998 | |
| JP | 2007031923 | A | 2/2007 | |
| KR | 20100041356 | A | 4/2010 | |

OTHER PUBLICATIONS

International Search Report and Written Opinion dated Sep. 28, 2017 for International Application No. PCT/CN2017/075897.

* cited by examiner

ONE-SIDE OF REVERSIBLE BEANIE WITH POM-POM

OTHER-SIDE OF REVERSIBLE BEANIE WITH POM-POM

REVERSIBLE BEANIE WITH A POM-POM

FIELD

The present disclosure is related to headwear, and more particularly, to a reversible beanie with a pom-pom and a method of manufacturing the reversible beanie.

BACKGROUND

Headwear can include various components. One type of headwear is a beanie, which may include a pom-pom. A beanie is typically manufactured in one-style. Thus, if a user is interested in a different style, then they must purchase another beanie.

SUMMARY

A reversible headwear and method of assembling thereof is provided. The reversible headwear, such as a beanie, includes a reversible headwear body and an accessory such as a pom-pom connected thereto. The reversible headwear body is adjustable between a first configuration and a second configuration. The headwear body has a first surface and an opposite second surface. The first and second surfaces correspond to outer and inner surfaces respectively in the first configuration of the headwear body, and to the inner and outer surfaces respectively in the second configuration of the headwear body. The headwear body has a through-hole extending from the first surface to the second surface. The pom-pom is configured to be connected to the headwear body to allow movement of the connected pom-pom through the through-hole for positioning the connected pom-pom over the opening on or over the outer surface when the headwear body is in the first configuration or the second configuration.

In various example embodiments, the headwear body is configured to turn or roll over from an inside to an outside to adjust between the first and second configurations. The headwear body can be formed of at least two or more layers, the through-hole extending through the layers. The first and second surfaces can have different patterns. The headwear body can include an overlock which is a reinforced area adjacent to the through-hole. The headwear body can comprise of yarn. The through-hole can be positioned on a top portion of the headwear body.

Furthermore, in the various example embodiments, the pom-pom can be configured to have connected thereto two pieces of string, which are connected to the headwear body at locations proximate the through-hole. The two pieces of string can engage the headwear body at two corresponding positions on opposite sides around the through-hole of the headwear.

BRIEF DESCRIPTION OF THE DRAWINGS

The description of the various exemplary embodiments is explained in conjunction with the appended drawings, in which.

DESCRIPTION OF VARIOUS EXAMPLE EMBODIMENTS

Figure 1:
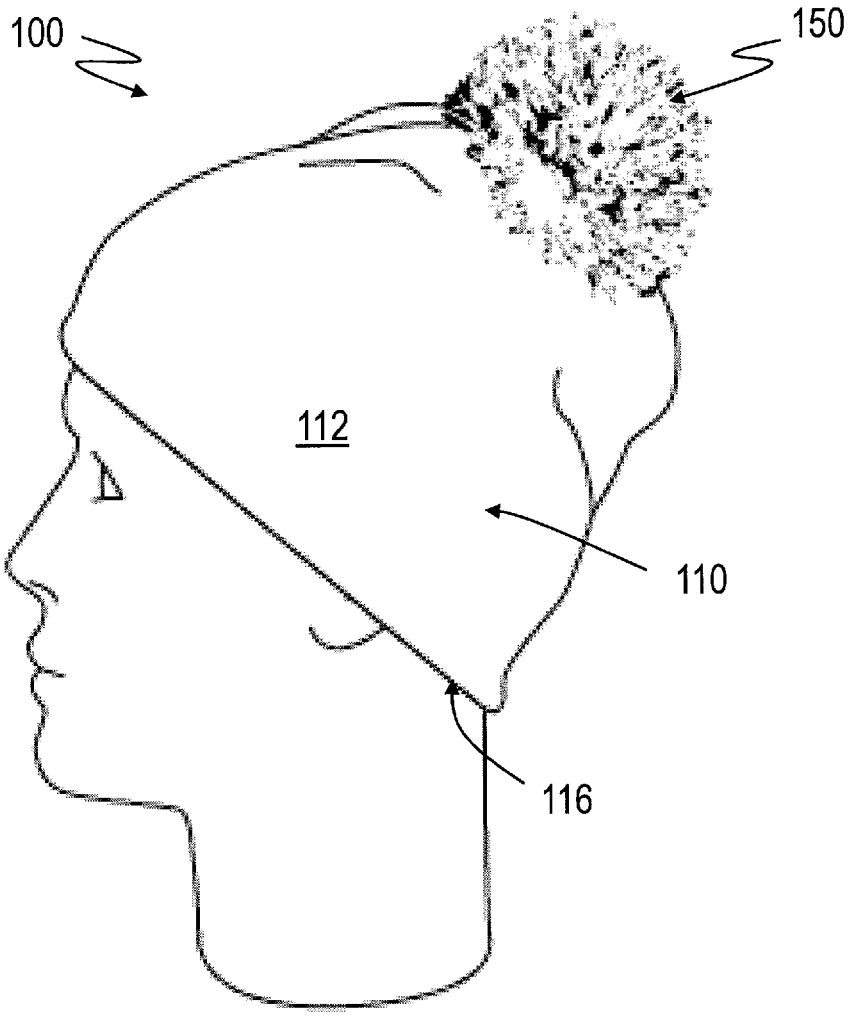
FIG. 1 is a perspective view of an example of a first configuration of a reversible headwear, such as a beanie, with a pom-pom, in accordance with an example embodiment of the present disclosure.
Figure 2:
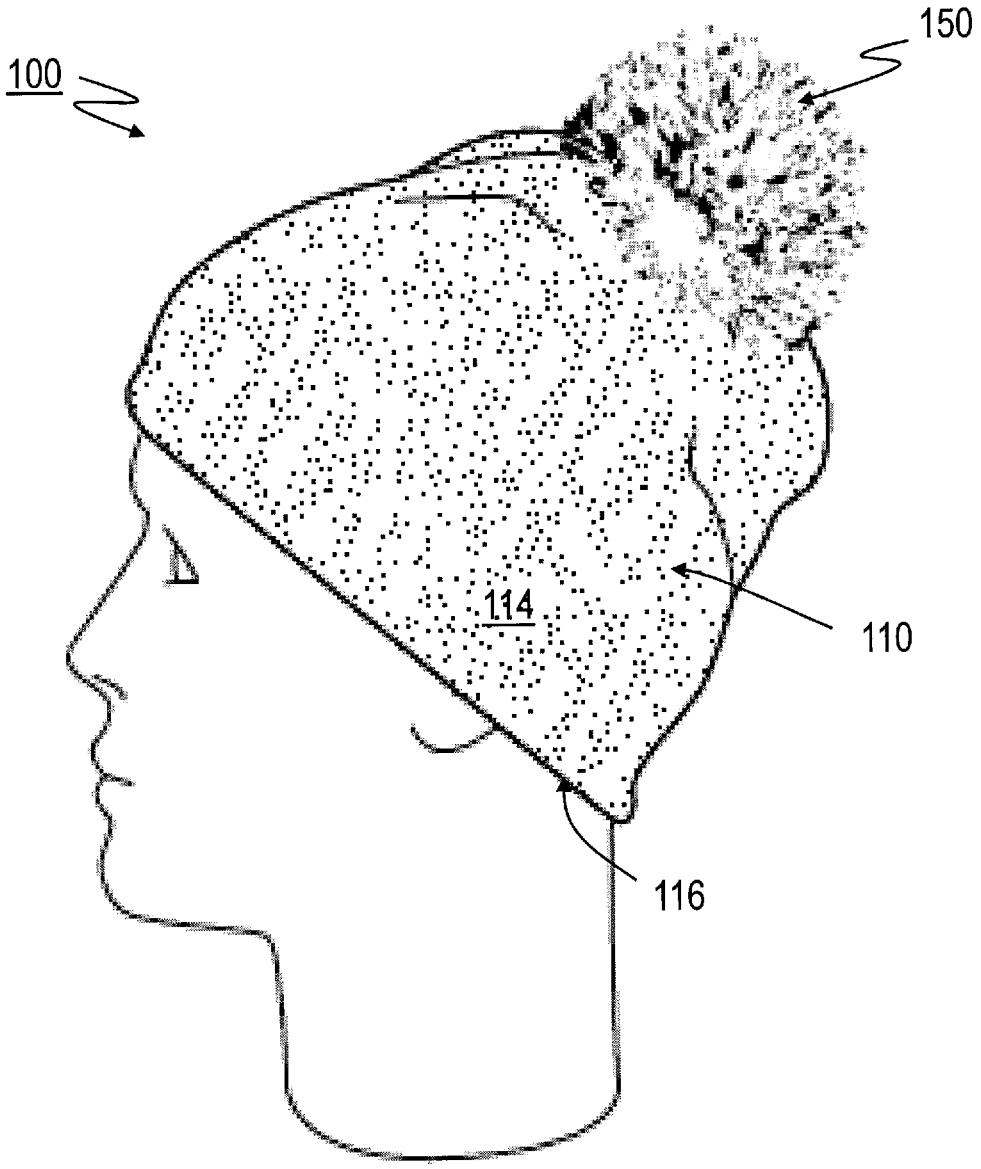
FIG. 2 is a perspective view of an example of a second configuration of the reversible headwear of FIG. 1, when the headwear is reversed, in accordance with an example embodiment of the present disclosure.

FIGS. 1 and 2 illustrate an example of a reversible headwear 100 with an accessory or decoration that is moveable or re-positionable. As shown in FIGS. 1 and 2, the headwear 100 includes a headwear body 110 and a accessory or decoration such as a pom-pom 150. In this example, the headwear 100 is a beanie. The pom-pom 150 is movably connected to a top and/or central portion of the headwear body 110, e.g., at a top or apex of the headwear body 110. The headwear body 110 includes a first surface 112 as shown in FIG. 1 and an opposite second surface 114 as shown in FIG. 2, and a bottom edge 116 (e.g., edge or rim).

The headwear body 110 is reversible between a first configuration in FIG. 1 and a second configuration in FIG. 2. In the first configuration, the headwear body 110 is configured with the first and second surfaces 112 and 114 as outer and inner surfaces, respectively, of the headwear body 110. In the second configuration, the headwear body 110 is configured with the first and second surfaces 112 and 114 as inner and outer surfaces, respectively, of the headwear body 110. The headwear body 110 can be reversed from the first configuration to the second configuration or vice-a-versa, for example, by turning or rolling over the headwear body 110 from an inside to an outside (e.g., flipping the headwear inside-out, etc.).

In either configurations, the pom-pom 150 can be positioned or re-positioned on or over the outer surface of the headwear body 110. As will be described in greater detail below, the headwear body 110 includes a through-hole (see e.g., through-hole 130 in FIG. 3) between the first and second surfaces 112, 114, through which the pom-pom 150, when connected, is moveable for positioning thereof over the through-hole on or over the outer surface of the headwear body 110 whether in the first or second configuration.

As further shown in FIGS. 1 and 2, the headwear body 110, in this example, has a hemispherical shape (e.g., a dome shape) or the like, and is formed of a fabric(s) or other suitable material(s) for a headwear such as a beanie. The fabric can be a woven fabric or non-woven fabric such as a knit fabric. In one example, the fabric is yarn (e.g., acrylic yarn, wool yarn, microfiber yarn, cotton yarn, or any other type of yarn, etc.). The headwear body 110 can be formed of one, two or more layers, which can be made or formed of the same or different fabric(s) or material(s). The first and second surfaces 112, 114 (and their corresponding layers) can have the same pattern, or a different pattern (e.g., FIGS. 1 and 2).

The pom-pom 150 can be a decorative feature or accessory on the headwear 100, and can take the form of a ball or tuft with fibrous material. The pom-pom 150 can, for example, be made of acrylic, wool, microfiber, cotton, or other suitable materials for use in a headwear such as a beanie. The pom-pom 150 can be compressed to a compressed state, or expanded to an expanded or fluffed state. The pom-pom 150 can be compressed and pushed through a through-hole on the headwear body 110 to re-position the pom-pom 150 on the headwear 100. The pom-pom 150 can have a diameter or width, such as when in the expanded or fluffed state, that is larger than the through-hole and can cover the through-hole when positioned on or over the outer surface of the headwear body 110.

Figure 3:
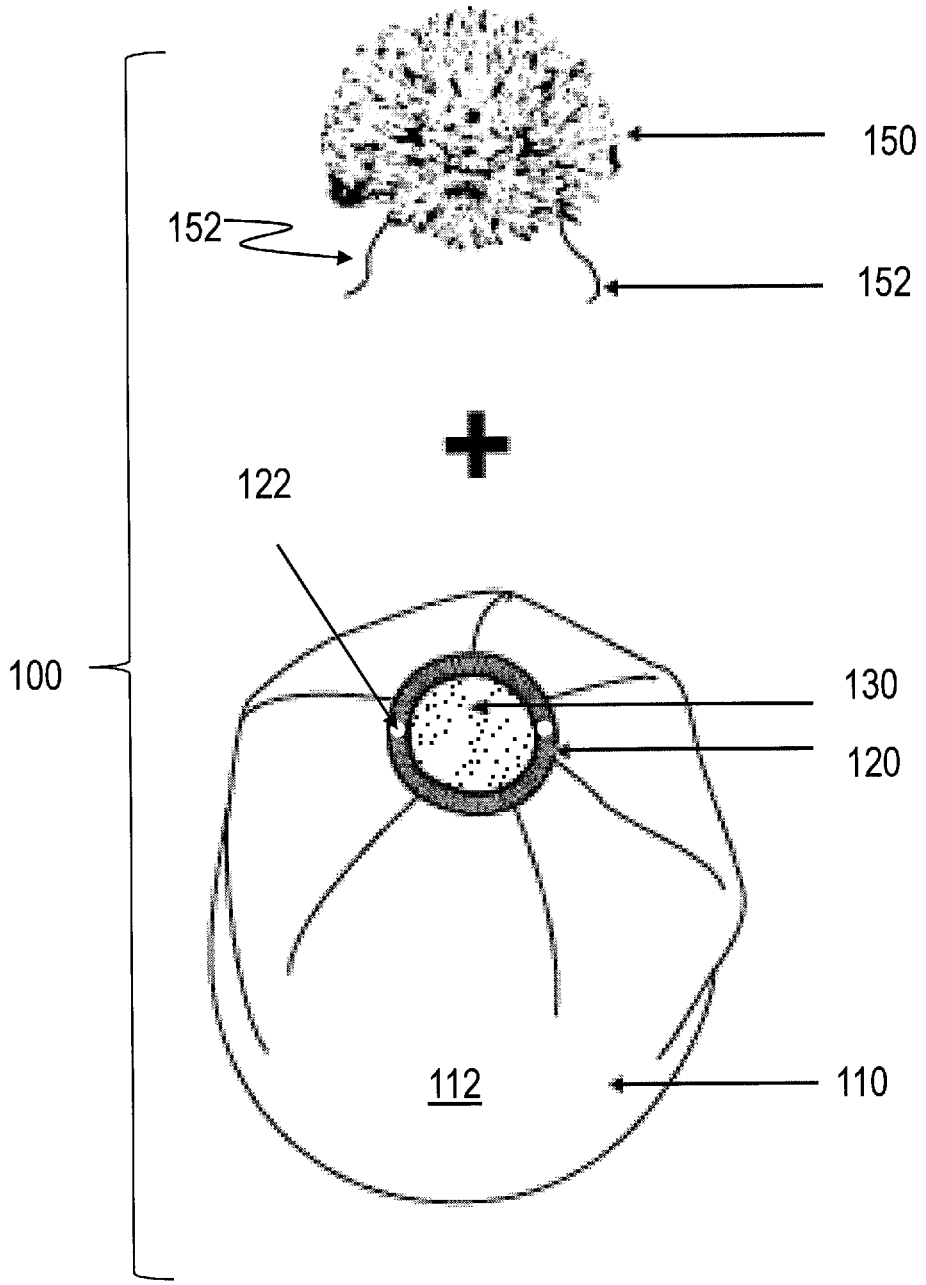
FIGS. 3 through 5 illustrate example operations to assemble the reversible headwear of FIGS. 1 and 2, in accordance with an example embodiment of the present disclosure.
Figure 4:
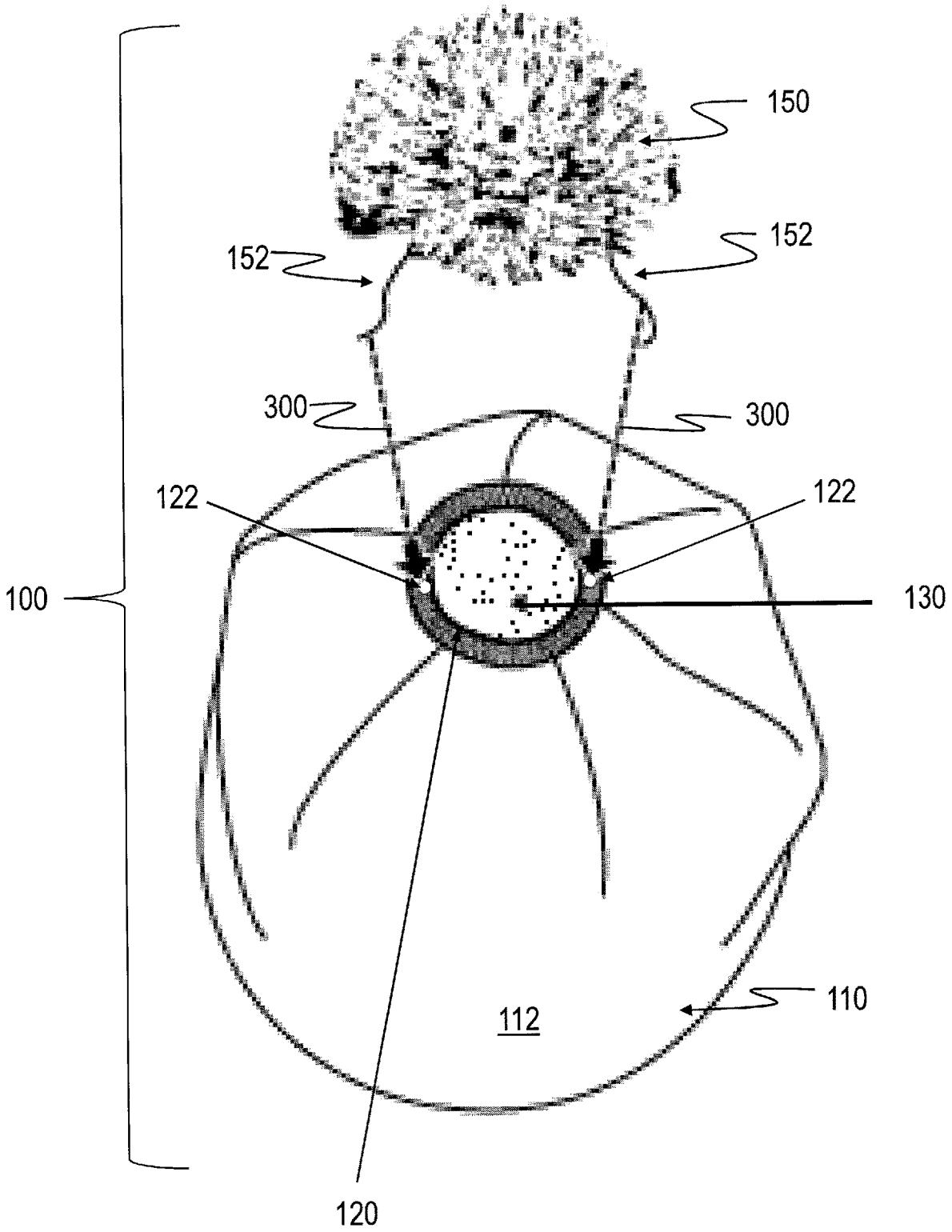
Figure 5:
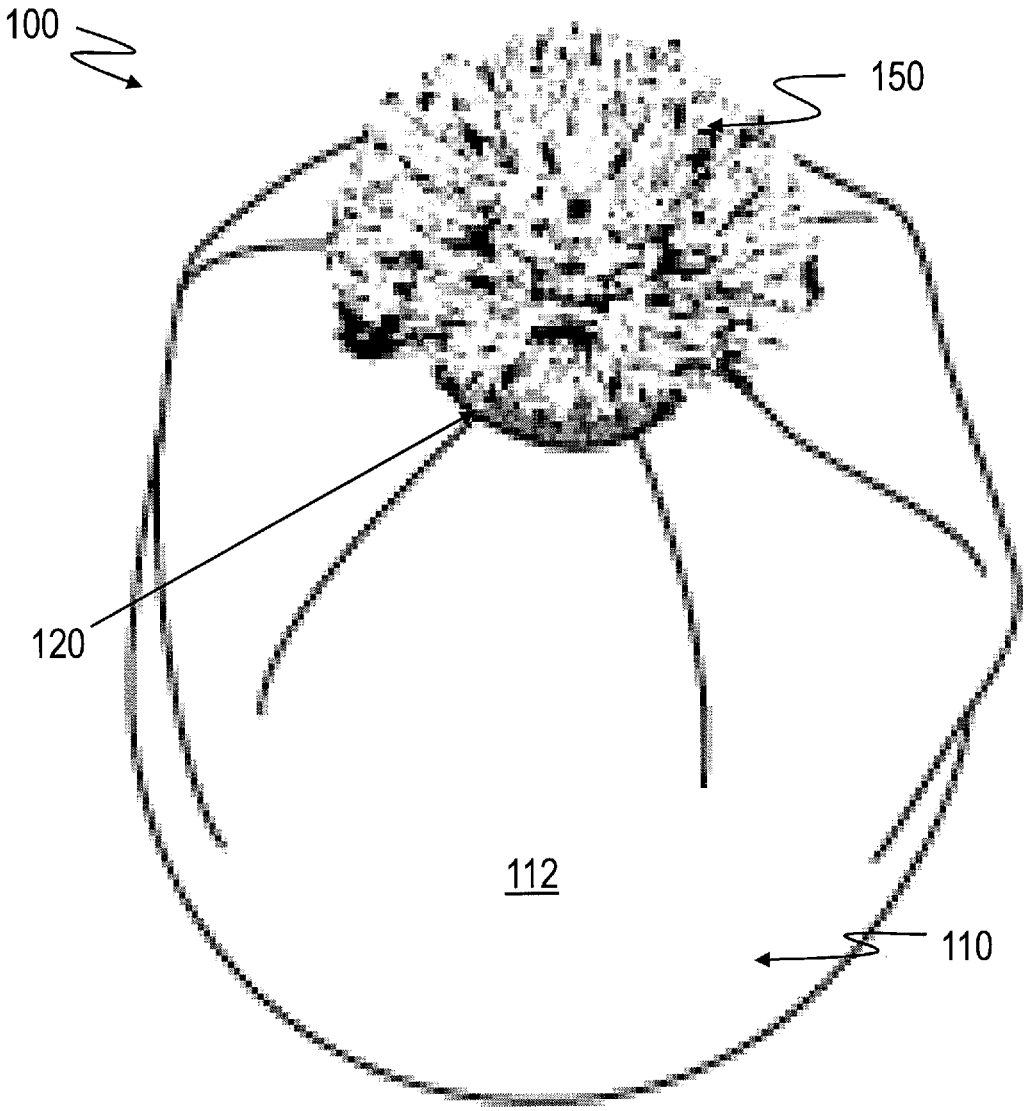

FIGS. 3 through 5 illustrate example operations for assembling or manufacturing a reversible headwear, such as the reversible headwear 100 of FIGS. 1 and 2. FIG. 3 shows an exploded view of the headwear 100, which includes the headwear body 110 and the pom-pom 150. In this example, the headwear 100 further includes a plurality of strings or pieces of string 152, e.g., two pieces of string, which are connected or to be connected on one end to the pom-pom 150. As shown in FIG. 3, the headwear body 110 includes an overlock 120, such as an inner rim or edge, which defines the through-hole 130. The overlock 120 is a region or area which is proximate or adjacent to the through-hole 130 and is reinforced such as, for example, with stitching, sewing or hemming (e.g., a stitched, sewed or hemmed region) or other fabric reinforcing technique (e.g., fabric tape, coating, etc.). The through-hole 130 may be a cutout, which can have a circular, elliptical or other suitable shape and size relative to the pom-pom 150.

As shown in FIG. 4, the pom-pom 150 is connected to the headwear body 110 using the pieces of string 152. For example, as reflected by reference numeral 300, a free end of each piece of string 152 is engaged to the headwear body 110 through an opening 122 in the overlock 120 of the headwear body 110, and is then tied up or knotted or secured to form a joining in order to connect or secure the pom-pom 150 to the headwear body 110. In this example, the two pieces of string 152 engage the headwear body 110 at two positions on opposite sides around the through-hole 130 of the headwear body 110. Although two pieces of string 152 are shown, it should be understood that any number of pieces of string 152 can be used to connect the pom-pom 150 to the headwear body 110.

An example of the headwear 100 with the headwear body 110 connected to the pom-pom 150 is shown in FIG. 5, in which the headwear 100 is in the first configuration. As shown in FIG. 5, the pom-pom 150, when connected, can be positioned on or over the outer surface (in this case the first surface 112) and over the through-hole 130 to cover the through-hole 130. A portion of the pom-pom 150, e.g., a bottom portion, may sit in and cover the through-hole 130.

Figure 6:
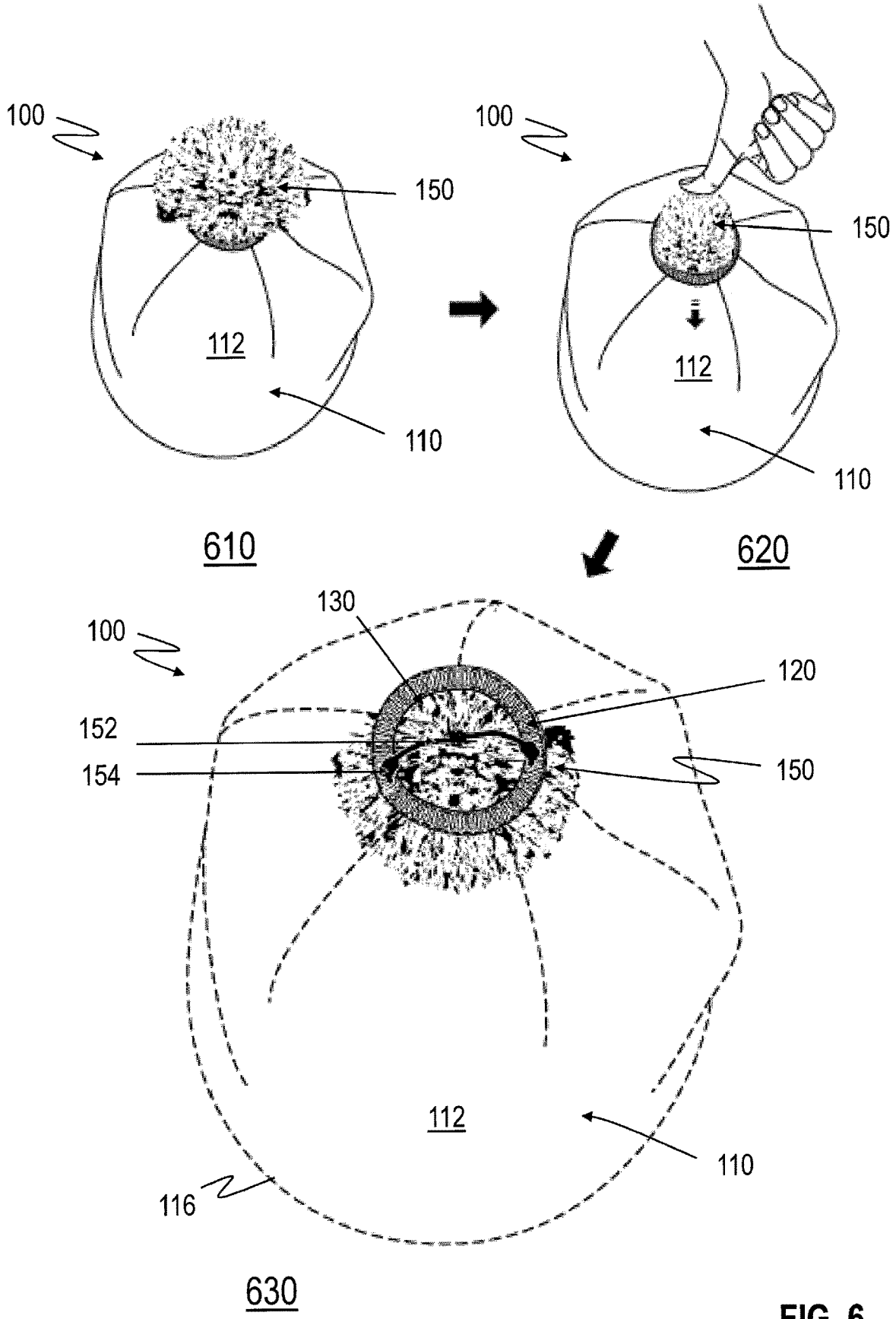
FIGS. 6 through 7 illustrate example operations to reverse the headwear of FIGS. 1 and 2 between the first and second configurations, in accordance with an example embodiment of the present disclosure.
Figure 7:
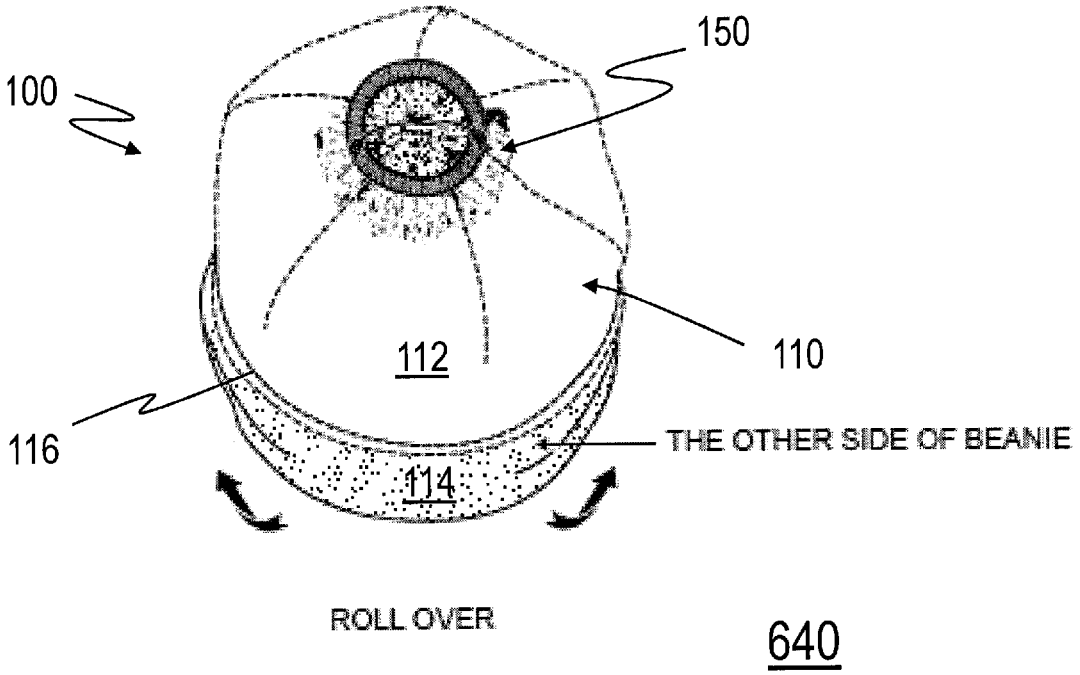
Figure 7:
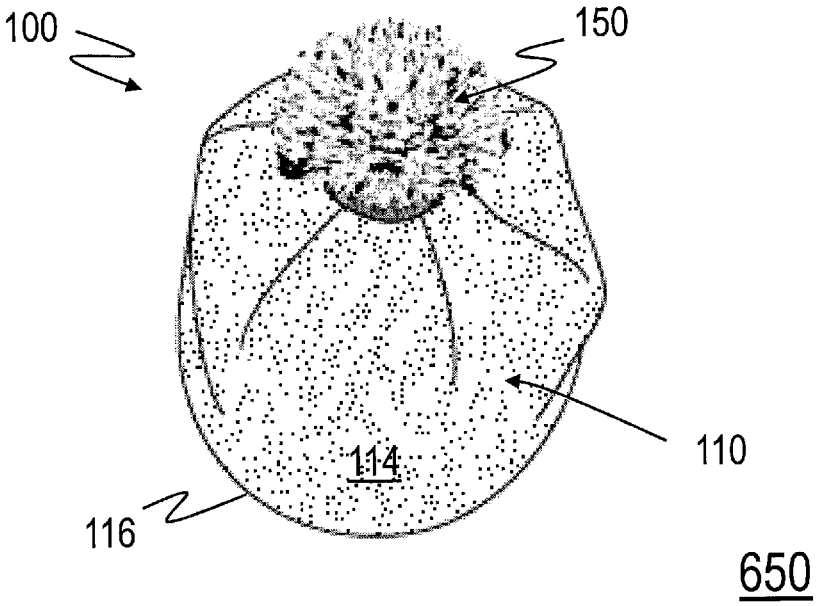
Figure 8:
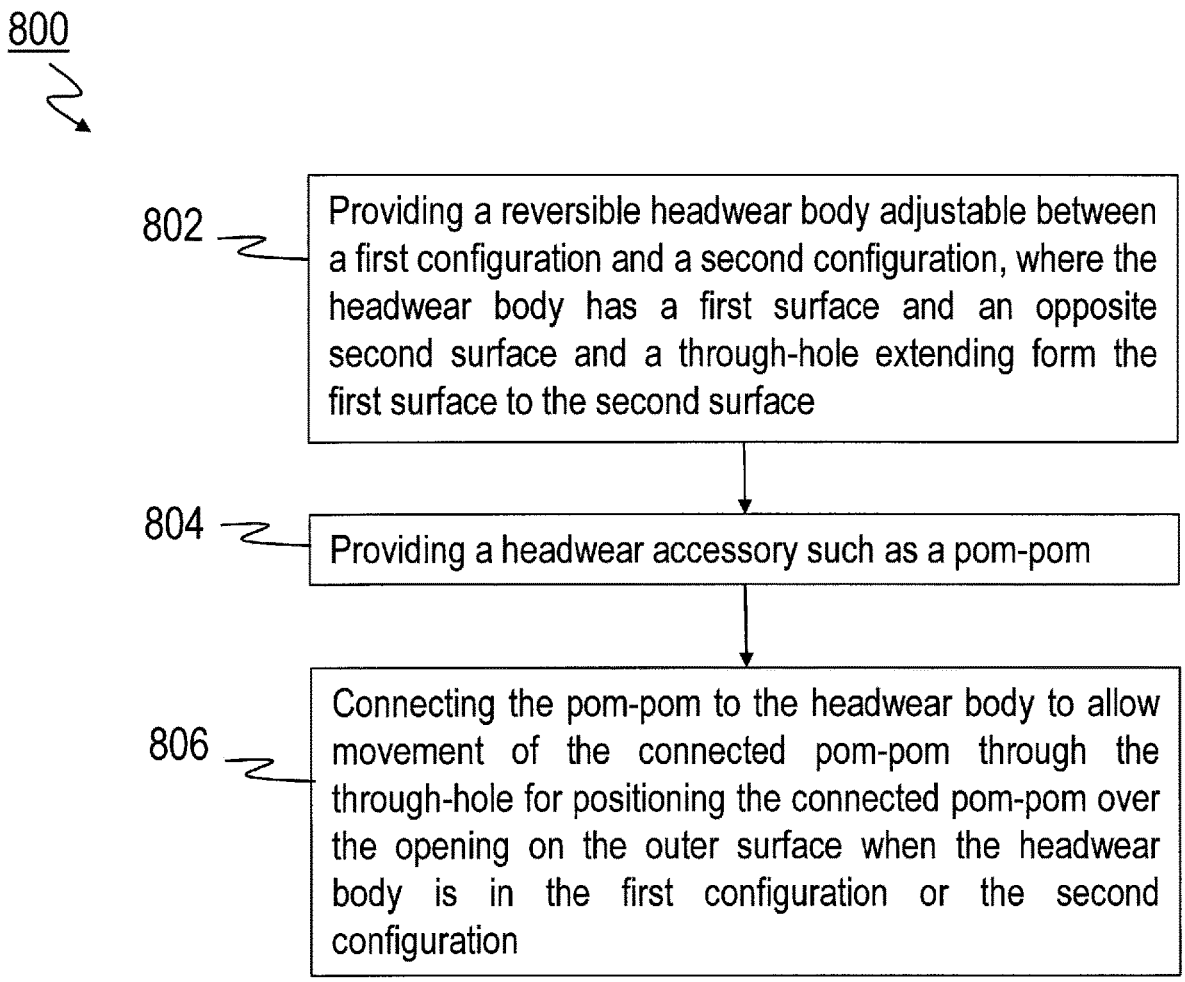
FIG. 8 illustrates a process by which to manufacture or assembly a reversible headwear, such as in FIGS. 1 and 2, in accordance with an example embodiment of the present disclosure.

FIGS. 6 through 7 illustrate example operations of reversing the headwear 100 from the first configuration as shown in FIG. 1 to the second configuration as shown in FIG. 2. In FIG. 6, at reference 610, the headwear 100 is shown in the first configuration in which the first surface 112 is the outer surface. At reference 620, the pom-pom 150 is moved through the through-hole 130 by pushing the pom-pom 150 through the through-hole 130 to the other side, e.g., the second surface 114 which is presently the inner surface and is not shown. At reference 630, the pom-pom 150 is positioned on or over the other side, e.g., the second surface 114. The pom-pom 150 is connected, in this example, with two pieces of string 152. For example, as shown in the reference 630, a portion of each of the two pieces of string 152 is knotted or tied or secured to form a joining 154 in order to connect the pom-pom 150 to the headwear body 110. The pom-pom 150 is connected to the headwear body 110 with sufficient slack or flexibility to allow movement of the pom-pom 150, when connected, through the through-hole 130 for positioning on or over the first surface 112 or second surface 114 of the headwear body, and over the through-hole 130.

Thereafter, as shown by reference 640 in FIG. 7, the headwear 100 can be reversed from the bottom edge 116, by turning or rolling over the headwear body 110 from an inside to an outside, until the headwear body 110 is in the second configuration with the second surface 114 becoming the outer surface and the first surface 112 becoming the inner surface. The headwear 100 is shown in the second configuration at reference 650, with the connected pom-pom 150 positioned on or over the outer surface, which, in this case, is the second surface 114. The headwear 100 in the second configuration can then be worn on a user's head, such as shown in FIG. 2. These operations, described above, can be repeated to reverse the headwear 100 back to the first configuration, which can then be worn on a user's head, such as shown in FIG. 1.

FIG. 800 is a flow diagram of an example process 800 by which a reversible headwear, such as the headwear 100 which is shown in FIGS. 1 and 2, is assembled or manufactured.

At reference 802, a reversible headwear body (e.g., 110) is provided which is adjustable between a first configuration and a second configuration. The headwear body has a first surface and an opposite second surface, and a through-hole extending from the first surface to the second surface. The first and second surfaces correspond to outer and inner surfaces respectively in the first configuration of the headwear body, and correspond to the inner and outer surfaces respectively in the second configuration of the headwear body. The headwear body has a through-hole extending from the first surface to the second surface At reference 804, a headwear accessory such as a pom-pom (e.g., 150) is provided.

At reference 806, the pom-pom is connected to the headwear body to allow movement of the connected pom-pom through the through-hole for positioning the connected pom-pom over the opening on or over the outer surface when the headwear body is in the first configuration or the second configuration. For example, the pom-pom can be connected using one or more strings or pieces of strings (e.g., two), or other connection mechanism (e.g., a fastener) which provides sufficient slack or flexibility to allow movement of the pom-pom, when connected, via the through-hole to a position over the through-hole on or over the outer surface of the headwear body.

It should be understood that the headwear and various method or processes, such as for manufacturing or manipulating/reversing the headwear, which are shown and described herein are provided as examples. The various method or process operations herein can be performed in combination with others operations, or in a different order with some or all of the operations.

It should be understood that the headwear can include a headwear body with one, two or more layers, which are formed of woven or non-woven material(s). Although the headwear in FIGS. 1 and 2 is shown as a particular type of a beanie, the manufacturing technique can be used to assemble or manufacture other types of beanies or headwear with a pom-pom and having a different or varying size, shape and configuration. The headwear may include other components.

The pom-pom can be connected to the headwear body using various connecting mechanisms (e.g., fastener or fastening mechanisms) or the like, which provide for sufficient slack or flexibility to allow movement of the pom-pom through the through-hole of the headwear body and positioning thereof over the through-hole on or over an outer surface of the headwear. When using string(s) or the like, the opening in the overlock or headwear body to receive a portion of the string can be pre-formed (e.g., cut-out, weaved or knitted with an opening or space, etc.). The pom-pom and through-hole can be positioned at a top, central portion of the headwear body, or any desired portion of the headwear body. The piece(s) of string may be formed of the same or similar material as the pompom or headwear body, or may be formed of a resilient or non-resilient material. The headwear may also include one or more pom-poms and one or more through-holes, such as described herein.

Words of degree, such as "about", "around", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

What is claimed is:

1. A method of assembling a reversible headwear comprising:

providing a reversible headwear body adjustable between a first configuration and a second configuration, the headwear body having a first surface and an opposite second surface, the first and second surfaces corresponding to outer and inner surfaces respectively in the first configuration of the headwear body and corresponding to the inner and outer surfaces respectively in the second configuration of the headwear body, the headwear body having a through-hole extending from the first surface to the second surface;

providing a pom-pom; and connecting the pom-pom to the headwear body to allow movement of the connected pom-pom through the through-hole for positioning the connected pom-pom over the through-hole on or over the outer surface when the headwear body is in the first configuration or the second configuration.

2. The method according to claim 1, wherein the headwear body is configured to turn or roll over from an inside to an outside to adjust between the first and second configurations.

3. The method according to claim 1, wherein the headwear body is formed of at least two or more layers, the through-hole extending through the layers.

4. The method according to claim 1, wherein the first and second surfaces have different patterns.

5. The method according to claim 1, wherein the headwear body includes an overlock which is a reinforced area adjacent to the through-hole.

6. The method according to claim 1, wherein the through-hole is positioned on a top portion of the headwear body.

7. The method according to claim 1, wherein the headwear body comprises yarn.

8. The method according to claim 1, wherein the pom-pom is configured to have connected thereto two pieces of string, the connecting the pom-pom comprising:

connecting the two pieces of string to the headwear body at locations proximate the through-hole.

9. The method according to claim 8, wherein the two pieces of string engage the headwear body at two corresponding positions on opposite sides around the through-hole of the headwear.

10. The method according to claim 1, wherein the headwear is a beanie.

11. A headwear, comprising:

a reversible headwear body adjustable between a first configuration and a second configuration, the headwear body having a first surface and an opposite second surface, the first and second surfaces corresponding to outer and inner surfaces respectively in the first configuration of the headwear body and corresponding to the inner and outer surfaces respectively in the second configuration of the headwear body, the headwear body having a through-hole extending from the first surface to the second surface; and a pom-pom connected to the headwear body to allow movement of the connected pom-pom through the through-hole for positioning the connected pom-pom over the through-hole on or over the outer surface when the headwear body is in the first configuration or the second configuration.

12. The headwear according to claim 11, wherein the headwear body is configured to turn or roll over from an inside to an outside to adjust between the first and second configurations.

13. The headwear according to claim 11, wherein the headwear body is formed of at least two or more layers, the through-hole extending through the layers.

14. The headwear according to claim 11, wherein the first and second surfaces have different patterns.

15. The headwear according to claim 11, wherein the headwear body includes an overlock which is a reinforced area adjacent to the through-hole.

16. The headwear according to claim 11, wherein the through-hole is positioned on a top portion of the headwear body.

17. The headwear according to claim 11, wherein the headwear body comprises yarn.

18. The headwear according to claim 11, wherein the pom-pom has connected thereto two pieces of string, which are connected to the headwear body at locations proximate the through-hole.

19. The headwear according to claim 18, wherein the two pieces of string engage the headwear body at two corresponding positions on opposite sides around the through-hole of the headwear.

20. The headwear according to claim 11, wherein the headwear is a beanie.

* * * * *